US005648644A

United States Patent [19]

Nagel

[11] Patent Number: 5,648,644

[45] Date of Patent: Jul. 15, 1997

[54] BRAKE REGULATING APPARATUS FOR AN ELEVATOR CAR

[75] Inventor: Heinz-Dieter Nagel, Berlin, Germany

[73] Assignee: Inventio AG, Hergiswil, Switzerland

[21] Appl. No.: 324,789

[22] Filed: Oct. 18, 1994

[30] Foreign Application Priority Data

Oct. 18, 1993 [EP] European Pat. Off. ..... 93116780

[51] Int. Cl.[6] ..... B66B 1/32; B66B 5/16

[52] U.S. Cl. ..... 187/288; 187/351; 187/359

[58] Field of Search ..... 187/288, 359, 187/349, 409, 373, 374, 375, 351

[56] References Cited

U.S. PATENT DOCUMENTS

| | | | |
|---|---|---|---|
| 1,937,035 | 11/1933 | Dunlop | 187/89 |
| 3,942,607 | 3/1976 | Sobat | 187/77 |
| 5,096,020 | 3/1992 | Korhonen | 187/88 |
| 5,228,540 | 7/1993 | Glaser | 187/89 |
| 5,353,895 | 10/1994 | Camack et al. | 187/369 |
| 5,363,942 | 11/1994 | Osada | 187/376 |
| 5,402,863 | 4/1995 | Okumura et al. | 187/288 |
| 5,503,257 | 4/1996 | Sugita et al. | 188/251 |

FOREIGN PATENT DOCUMENTS

| | | | |
|---|---|---|---|
| 3934492 | 4/1990 | Germany . | |
| 4-272077 | 9/1992 | Japan | 187/288 |
| 6-1560 | 1/1994 | Japan | 187/288 |
| 1404450 | 6/1988 | U.S.S.R. . | |
| 1514722 | 10/1989 | U.S.S.R. | 187/288 |
| 1659340 | 6/1991 | U.S.S.R. | 187/288 |
| 1654207 | 6/1991 | U.S.S.R. | 187/288 |
| 1680615 | 9/1991 | U.S.S.R. | 187/288 |
| 2241488 | 9/1991 | United Kingdom | 187/288 |

*Primary Examiner*—Robert Nappi
*Attorney, Agent, or Firm*—Howard & Howard

[57] ABSTRACT

An elevator brake regulating apparatus includes brake actuators, a source of pressured fluid and a brake regulating control connected between the actuators and the fluid source. A fastening housing is attached to a carrier frame of a elevator car and has recesses for retaining guides of a brake shoe with elastic pads to provide vertical displacement of the guides under braking. The brake shoe has brake pads for engaging running surfaces of a guide rail. A brake sensor in each brake pad monitors the condition of the brake pad and signals the control to apply pressured fluid to actuate the corresponding brake actuator. Other sensors for speed, acceleration and retardation of the elevator car are connected to the control for selectively applied the pressured fluid to regulate the braking force on the elevator car.

20 Claims, 6 Drawing Sheets

BRAKE REGULATING APPARATUS FOR AN ELEVATOR CAR

BACKGROUND OF THE INVENTION

The present invention relates generally to an apparatus for braking elevator cars and, in particular, to an apparatus for controlling retardation forces during emergency braking.

An elevator car braking apparatus with two scissors-like frame members, at which a wedge-shaped friction member and a brake block are arranged at one end and a compression spring and an electromagnet are arranged at the other end, is shown in the German patent DE-A1 3 934 492. In case of an emergency, the wedge-shaped friction member is moved upwardly by a device so that a friction force initiated by the brake block on a guide rail slows down and stops the downwardly moving elevator car. The slowing-down of the elevator car is measured by means of an acceleration-measuring sensor. A feedback regulator feeding the brake electromagnet is controlled on the basis of the data supplied by the measuring sensor such that the friction force between the guide rail and the brake block maintains a constant slowing-down of the elevator car.

A disadvantage of the above described braking apparatus is that much space is required for the scissors-like braking equipment, which in turn makes the arrangement of the guide equipment of the elevator car more difficult. A further disadvantage lies in the triggering device which is formed by a lever and the wedge-shaped friction member and which, in particular at the beginning of the slowing-down, causes uncontrollable peak retardation of the elevator car.

SUMMARY OF THE INVENTION

The present invention concerns a brake regulating apparatus for controlling the braking force exerted on an elevator car by a brake device engaging a guide rail. The apparatus includes a fastening housing for attachment to an elevator car and having at least one recess formed therein; a brake shoe having at least one brake guide attached thereto and being retained in the recess; at least one brake pad for engaging a running surface formed on a guide rail along which the elevator car travels, the brake pad being retained by the brake shoe; at least one brake actuator mounted in the brake shoe and being coupled to the brake pad for moving the brake pad into engagement with the running surface; and a brake regulating means having an inlet port for connection to a source of pressured fluid and an outlet port being connected to the brake actuator for selectively applying pressured fluid to the brake actuator whereby a relatively constant regulated braking force is exerted on the elevator car.

The invention avoids the disadvantages of the known braking equipment and of creates a safety device by which the retardation of the elevator car during the entire braking operation is maintainable at a constant value independently of the direction of travel.

The advantages achieved by the invention are that the elevator user is not subjected to unnecessary retardation forces during an emergency braking, which promotes travel comfort and safety even in the case of an emergency braking, and in particular for disabled users of elevators.

A further advantage is that the elevator car can be stopped utilizing the apparatus according to the present invention at any desired place for loading and unloading or maintenance operations.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
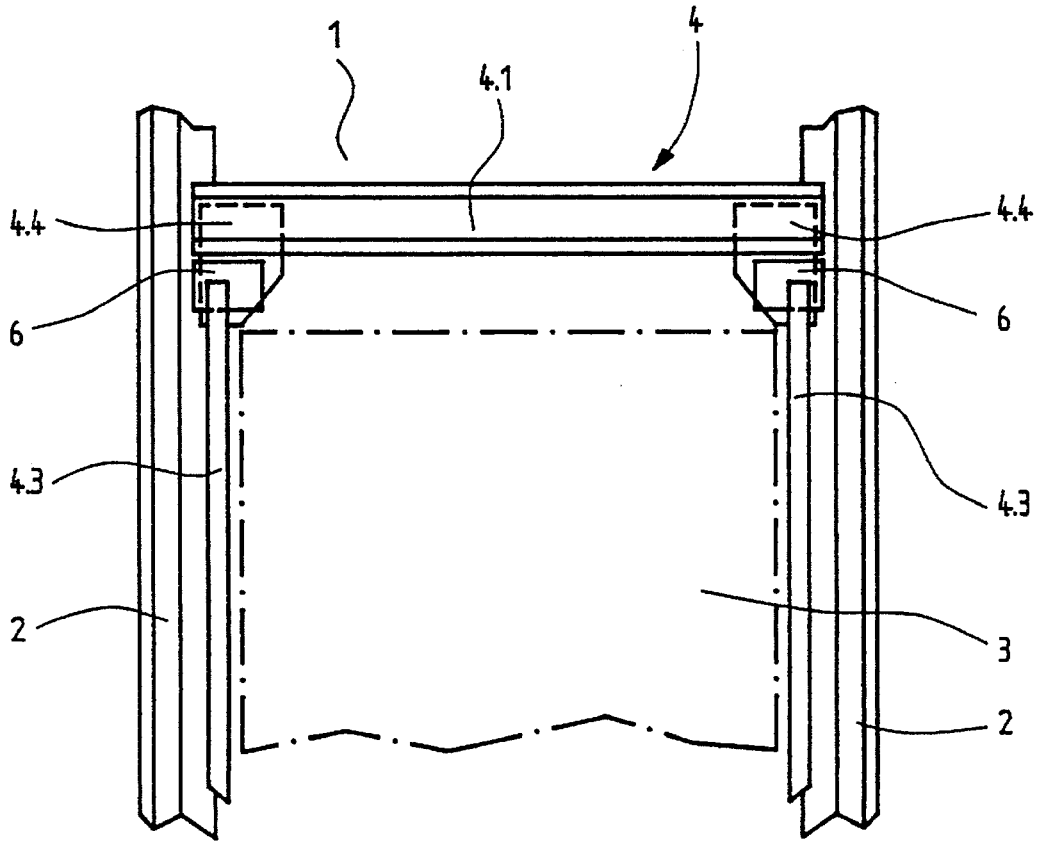
FIG. 1 is a schematic fragmentary front elevation view of an elevator car movable in a elevator shaft with a brake regulating apparatus at an upper yoke in accordance with the present invention.
Figure 2:
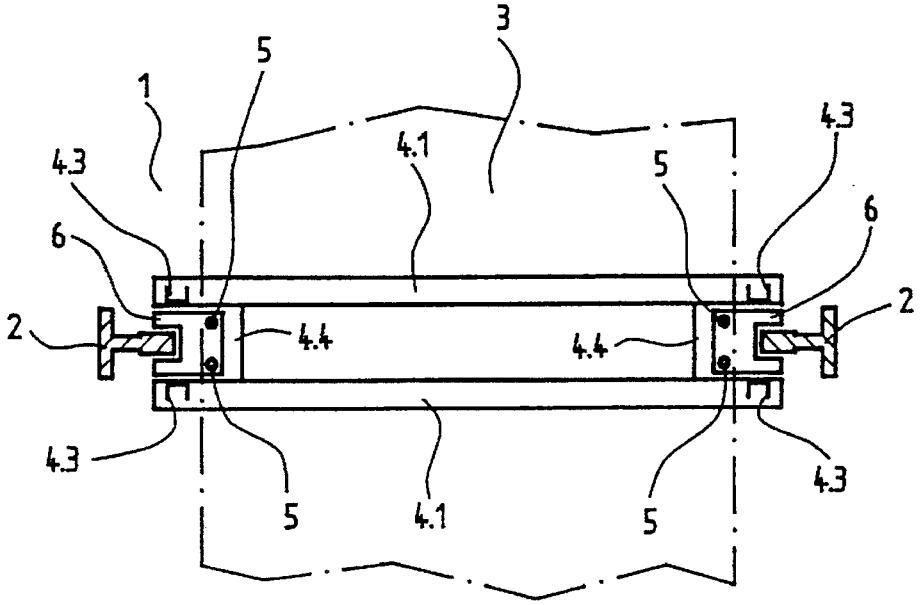
FIG. 2 is a fragmentary top plan view of the brake regulating apparatus shown in the FIG. 1.
Figure 3:
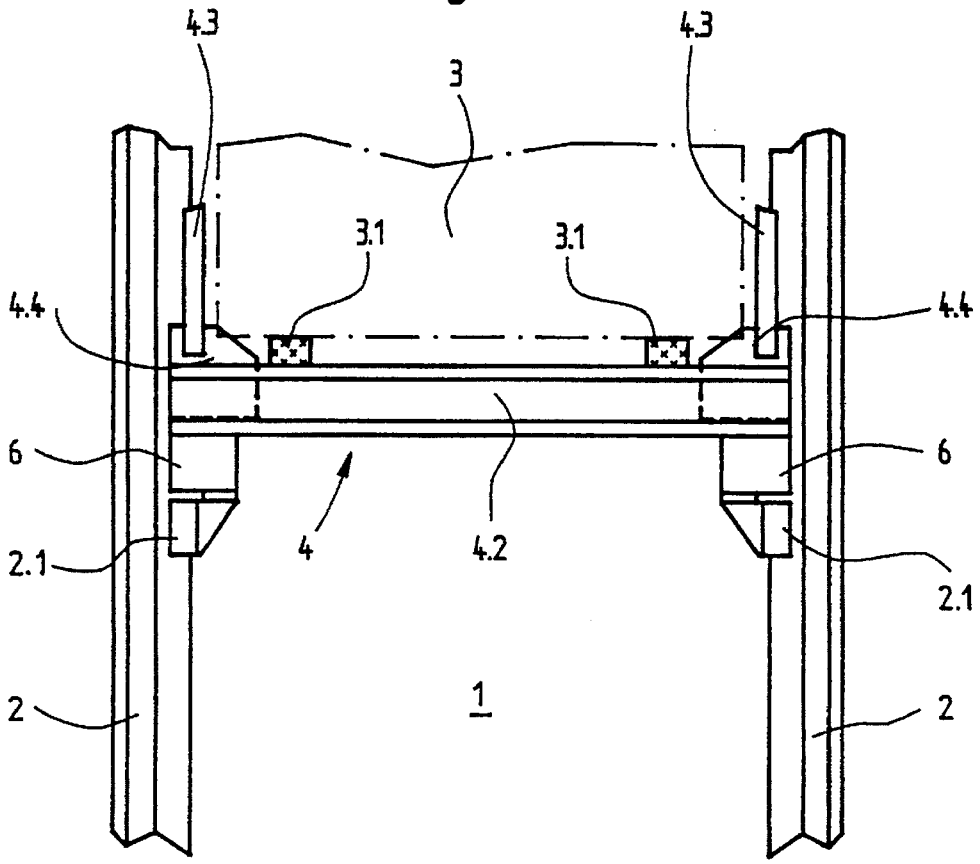
FIG. 3 is a schematic fragmentary front elevation view of the elevator car shown in the FIG. 1 with a brake regulating apparatus at a lower yoke in accordance with the present invention.
Figure 4:
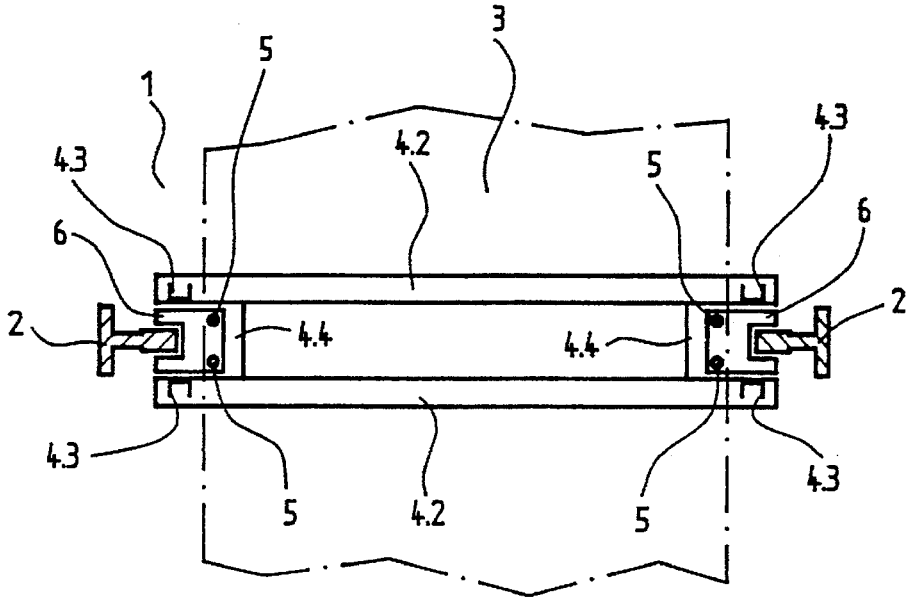
FIG. 4 is a fragmentary bottom plan view of the brake regulating apparatus shown in the FIG. 1.

There is shown in the FIGS. 1–4 an elevator shaft 1 in which a pair of vertically extending guide rails 2 are positioned along which an elevator car 3 is movable. The elevator car 3 is supported in a carrier frame 4 which consists of an upper yoke 4.1 positioned above the car and a lower yoke 4.2 positioned below the car. The yokes 4.1 and 4.2 are connected by two pairs of generally U-shaped cross section side channels 4.3, one pair of side channels extending vertically on either side of the car 3. Each end of the side channels 4.3 is attached to a corresponding one of a plurality of metal stiffening plates 4.4 which in turn are attached to the corners of the yokes. A separate pair of fasteners 5 threadably engage each end of each yoke. A separate fastening housing 6 of a brake regulating assembly can be connected to each end of the upper yoke 4.1 and the lower yoke 4.2 by a corresponding pair of the fasteners 5. As shown in the FIG. 3, a pair of load sensors 3.1 are positioned between the lower yoke 4.2 and the bottom of the car 3 for generating car load signals to the associated elevator control.

Figure 5:
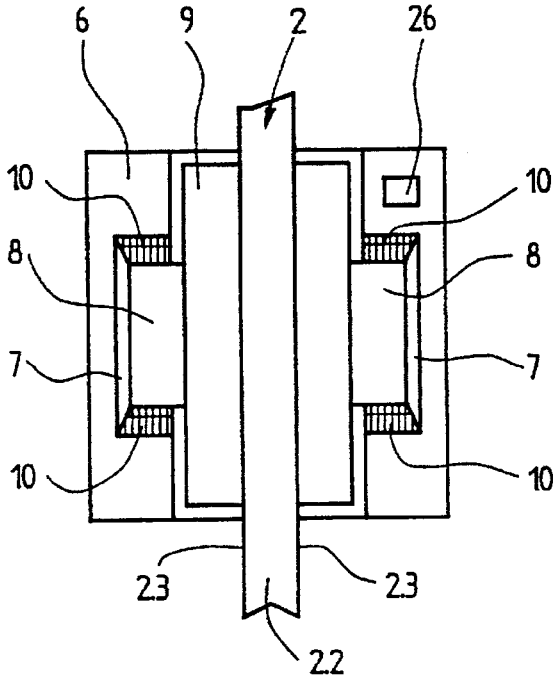
FIG. 5 is a schematic front elevation view of a braking assembly in a fastening housing of the brake regulating apparatus according to the present invention.
Figure 6:
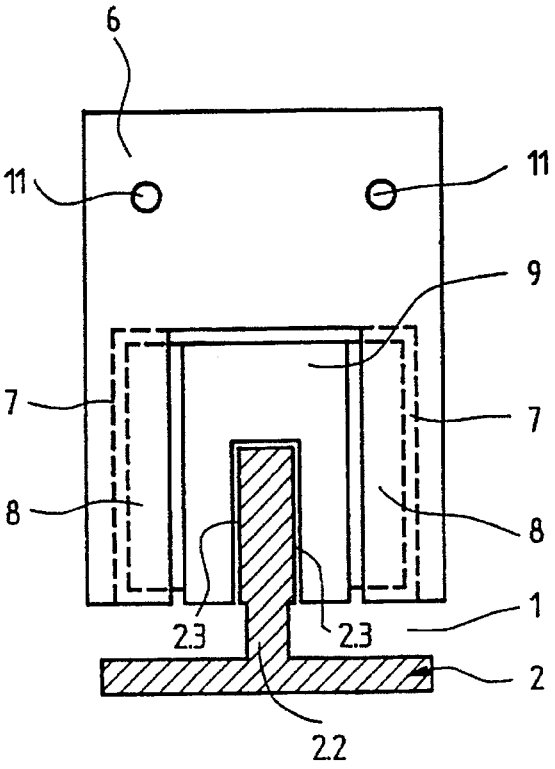
FIG. 6 is a top plan view of the braking assembly shown in the FIG. 5.

As shown in the FIGS. 5 and 6, each of the fastening housings 6 has a pair of spaced apart recesses 7 formed therein into which a pair of guides 8 attached to opposite legs of a generally U-shaped brake shoe 9 are inserted. Intermediate layers 10 or cushion pads are formed of an elastic material and positioned between upper and lower walls of the recesses 7 and adjacent sides of the guides 8, whereby the brake shoe 9 is supported in a manner to permit vertical displacement in the fastening housing 6. Thus, the brake shoe 9 is capable of following vertical deviations and tolerances of the guide rail 2 as desired during the braking operation. Thereby, no additional forces are generated to act on the guide rail 2, the carrier frame 4 or the elevator shaft 1. Each of the fastening housings 6 is attached to the carrier frame 4 with a pair of fastening apertures 11 formed in the fastening housing to receive the corresponding pair of the fasteners 5 and the brake shoe 9 embraces a center leg 2.2 of the generally T-shaped cross section rail 2.

Figure 7:
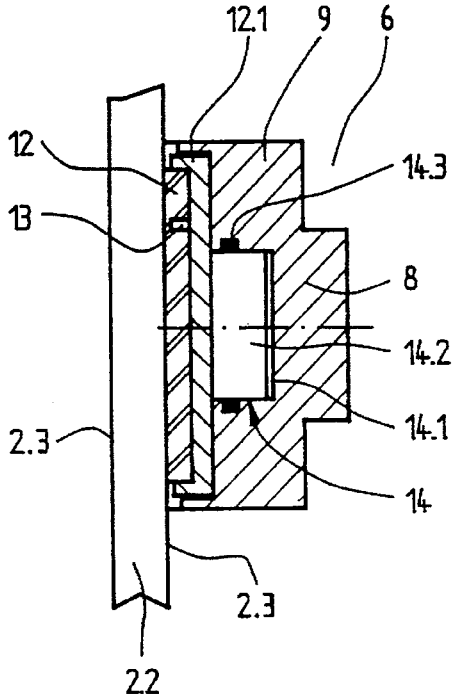
FIG. 7 is a cross-sectional view of a portion of the braking assembly shown in the FIG. 5.
Figure 8:
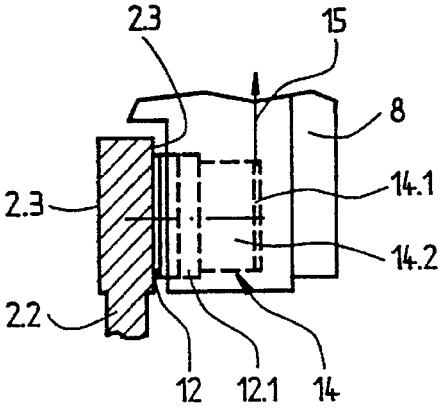
FIG. 8 is a fragmentary top plan view of the braking assembly shown in the FIG. 7.

The leg 2.2 has a pair of running surfaces 2.3 formed on opposite sides thereof each of which is engaged by a corresponding one of a pair of brake pads 12 of the brake shoe 9. As shown in the FIGS. 7–8, the brake shoe 9 includes one of the brake pads 12 for each leg thereof positioned adjacent a corresponding one of the running surfaces 2.3. Each of the brake pads 12 has a brake sensor 13 embedded therein which serves to monitor the brake pad. The brake sensor 13 can be, for example, a temperature-dependent resistor which generates a signal that is continuously evaluated by an elevator control 27 (FIG. 11) connected to the sensor. The control 27 stops the elevator car 3 upon an appropriate change in the sensor signal, for example due to excess temperature or wear of the brake pad 12. The brake pad 12 is carried by a brake pad holder 12.1 retained in the guide 8 and which is moved by a brake actuator 14 when braking the car 3. The actuator 14 is mounted on the brake shoe 9 and has a cylinder chamber 14.1, a piston 14.2 movable in the cylinder chamber and a pressure medium seal 14.3 retained in a wall of the chamber which cooperates with the piston 14.2. A pressure medium duct or line 15 has one end connected to the cylinder chamber 14.1 on a side of the piston 14.2 opposite the brake pad holder 12.1. As shown in the FIG. 11, an opposite end of the line 15 is connected through a brake regulating means or apparatus having a control 16 to a pressure medium source 17. When pressured fluid is supplied to the cylinder chamber 14.1 through the line 15, the piston 14.2 is moved to force the corresponding brake pad 12 against the adjacent running surface 2.3 to apply a regulated braking force to the elevator car 3.

Figure 9:
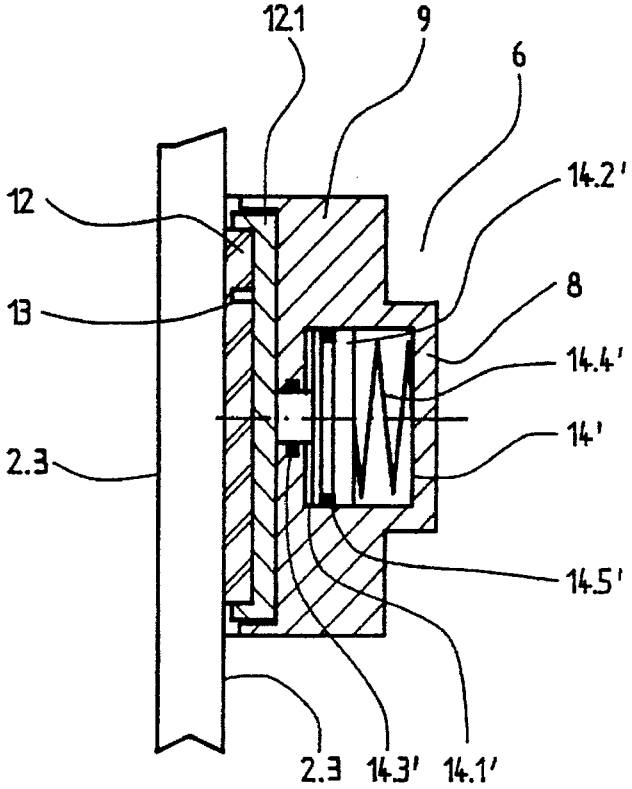
FIG. 9 is a cross-sectional view similar to the FIG. 7 of an alternate embodiment a braking assembly according to the present invention.
Figure 10:
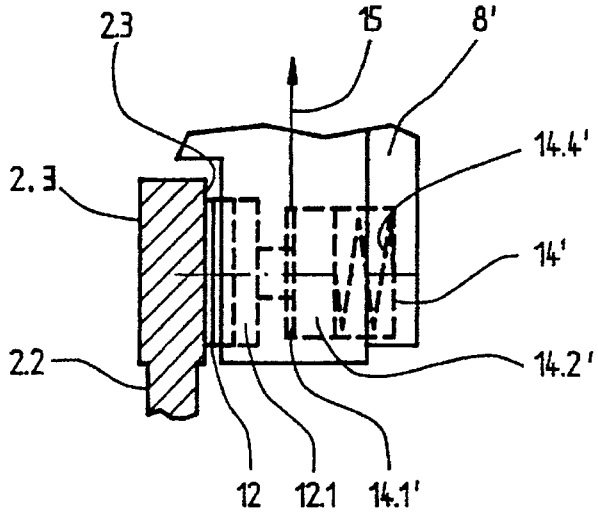
FIG. 10 is a fragmentary top plan view of the braking assembly shown in the FIG. 9.

An alternate embodiment of the brake actuator 14 is shown in the FIGS. 9 and 10 as a brake actuator 14' which includes a cylinder chamber 14.1' formed in a guide 8', a piston 14.2' movable in the chamber, a pressure medium seal 14.3' retained in a smaller diameter wall of the chamber which cooperates with the piston, a biasing means 14.4' such as a compression spring in the chamber and a piston seal 14.5' retained in the piston which cooperates with a larger diameter wall of the chamber. The braking force is produced by the compression spring 14.4' which moves the piston 14.2' to force the corresponding brake pad 12 against the adjacent running surface 2.3. The regulation of the braking force acting on the elevator car 3 is accomplished by introducing pressured fluid through the line 15 which is connected to the cylinder 14.1' on a side of the piston 14.2' adjacent the brake pad holder 12.1.

Figure 11:
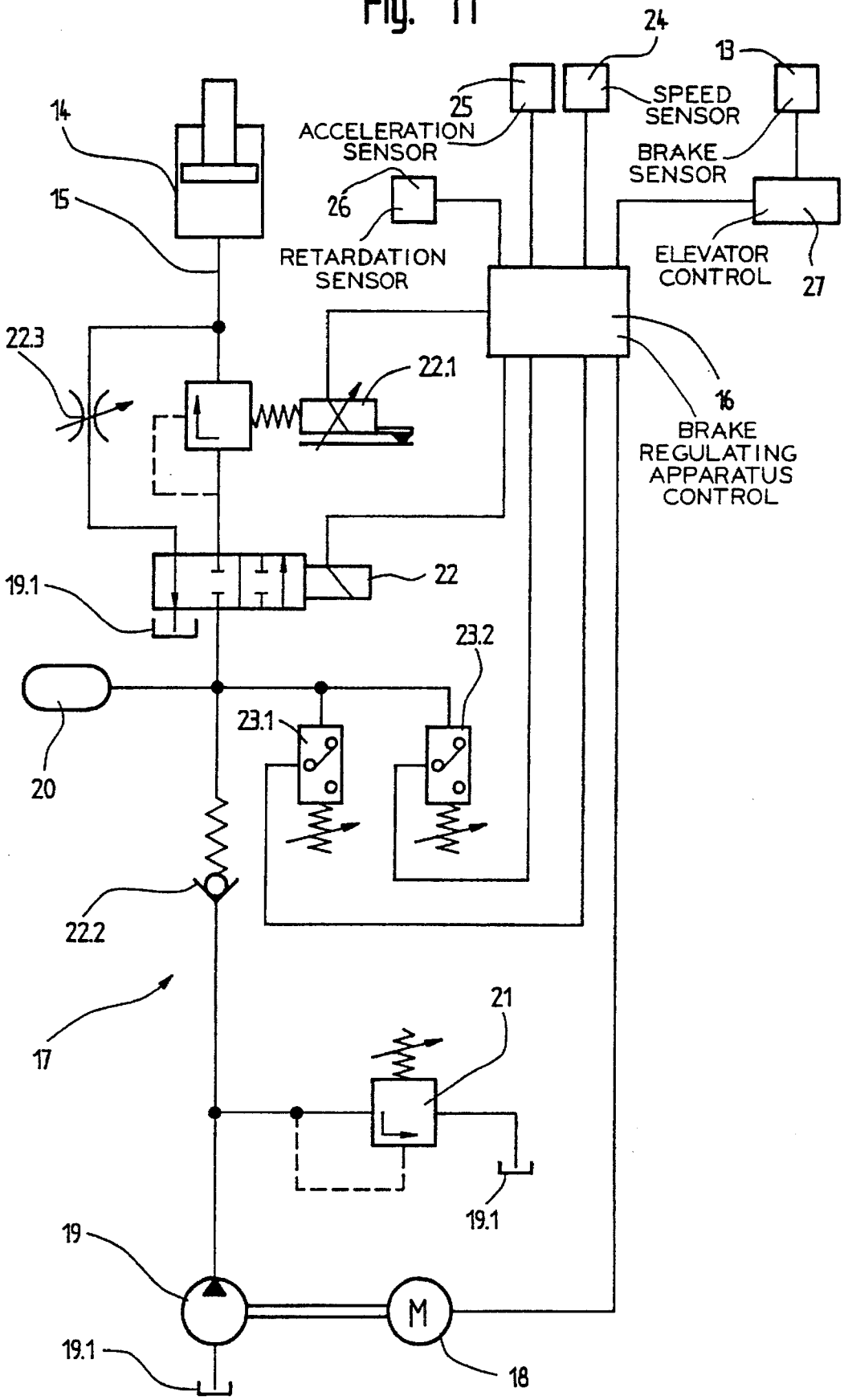
FIG. 11 is a schematic diagram of a hydraulic elevator system including a braking pressure regulating device.

As shown in the FIG. 11, the pressure medium source 17 connected to the brake regulating apparatus includes an electric motor 18, a fixed displacement hydraulic pump 19, a fluid tank or reservoir 19.1, a pressure fluid storage device or accumulator 20, a pressure limiting valve 21 and a three/two way control valve 22. The brake regulating apparatus includes the control 16, a pressure regulating valve 22.1, a first pressure switch 23.1, a second pressure regulating switch 23.2, a speed sensor 24, an acceleration sensor 25 and a retardation sensor 26. The motor 18 is connected to the brake regulating apparatus control 16 and is coupled to drive the pump 19. The pump 19 has an inlet connected to the reservoir 19.1 and an outlet connected to the accumulator 20, an inlet of the pressure limiting valve 21 and a first port of the control valve 22. The pressure limiting valve 21 has an outlet connected to the reservoir 19.1. The valve 22 has a second port connected to an inlet of the pressure regulating valve 22.1. A non-return or check valve 22.2 is connected to block fluid flow from either the accumulator 20 or the first port of the valve 22 back to the output of the pump 19. The first pressure switch 23.1 and the second pressure switch 23.2 each have an input connected to the accumulator 20 and to the first port of the valve 22. The switches 23.1 and 23.2 each have an output connected a separate input to the brake regulating apparatus control 16. An outlet of the valve 22.1 is connected to the line 15 and through an adjustable throttle valve 22.3 to a third port of the valve 22. A fourth port of the valve 22 is connected to the reservoir 19.1. The valve 22.1 has a pressure adjusting portion which is connected to an output of the control 16.

In operation, the motor 18 drives the pump 19 to supply pressured fluid from the reservoir 19.1 to the accumulator 20 until the maximum storage pressure set at the second pressure switch 23.2 is reached and the second pressure switch sends a signal to the control 16 which turns off the motor 18. In case the pressure in the accumulator 20 falls below a minimum value set at the first pressure switch 23.1, the first pressure switch sends a signal to the control 16 which turns on the motor 18 and the accumulator is charged again to the maximum storage pressure. The storage pressure is maintained greater than the braking pressure required for braking the elevator car. In the case of excess pressure, the pressure limiting valve 21 opens to short circuit the pump 19 to the reservoir 19.1. In the case of braking of the elevator car, the elevator control 27 sends a signal to the control 16 which has an output connected to an actuator for the control valve 22. The control 16 actuates the valve 22 from the position shown to connect the first and second ports and actuates the valve 22.1 thereby directing pressured fluid to the brake actuator 14. After braking is completed, the valve 22 and the valve 22.1 return to their initial states so that the pressured fluid in the cylinder chamber of the brake actuator 14 can be relieved to the reservoir 19.1 by the throttle valve 22.3.

For the establishment and maintenance of the operational readiness of the pressure medium source 17, the brake regulating apparatus control 16, in cooperation with the elevator control 27, switches the motor 18 on and off on the basis of the signals generated by the first pressure switch 23.1 and the second pressure switch 23.2. When the storage pressure in the accumulator 20 falls below a minimum pressure set at the first pressure switch 23.1, the brake regulating apparatus control 16, in response to the pressure switch signal switches the motor 18 on and the motor remains switched on until the maximum pressure set at the second pressure switch 23.2 is reached.

In the case of a fault or emergency during the downward direction of travel of the elevator car, the brake regulating apparatus control 16 switches the valve 22 and the valve 22.1 on in response to signals generated by a speed sensor 24 of a speed limiter or an acceleration sensor 25 both of which are connected to inputs of the elevator control 27 and sense values in excess of predetermined values. The pressured fluid in the accumulator 20 thus flows through the line 15 to the cylinder chamber 14.1 of the brake actuator 14 and causes the brake pad 12 to be urged against the corresponding running surface 2.3 of the guide rail 2. At the same time, a retardation sensor 26 mounted at the fastening housing 6 (FIG. 5) and connected to an input of the elevator control 27 measures the retardation of the elevator car 3. The brake regulating apparatus control 16 changes the setting of the pressure regulating valve 22.1 on the basis of the signal generated by the retardation sensor 26.

In the case of retardation values below a predetermined value such as the ordinary gravitational acceleration, the control 16 changes the setting of the valve 22.1 in such a manner that the braking force of the brake actuator 14 is increased until a retardation value corresponding to the ordinary gravitational acceleration is reached. When retardation values which are greater than the ordinary gravitational acceleration result due to different conditions of friction on the running surfaces 2.3 of the guide rail 2, the control 16 reduces the braking force of the brake actuator 14 by means of the valve 22.1 until a retardation value corresponding to the ordinary gravitational acceleration is reached. Thus, the retardation of the elevator car 3 remains constant and follows a predetermined value during the entire braking operation. The brake regulating apparatus 6 compares the predetermined value, for example the ordinary gravitational acceleration, with the value measured at the elevator car 3 by the retardation sensor 26 and balances out differences between the values by greater or lesser loading of the brake actuator 14 by means of the pressure regulating valve 22.1. As soon as the elevator car has come to standstill, the brake regulating apparatus control 16 changes the setting of the valve 22.1 in such a manner that the braking force of the brake actuator 14 reaches its maximum value. The elevator car 3 is thereby blocked or maintained in place in the elevator shaft 1.

In the case of a fault or emergency in the upward direction of travel, the braking operation takes place in substantially the same way as for the case of a fault or emergency in the downward travel direction. By reason of the opposite direction of movement ascertained by the speed sensor 24, the brake regulating apparatus control 16 fixes the predetermined retardation value which lies below the ordinary gravitational acceleration and influences the braking force of the brake actuator 14 accordingly.

For the loading or unloading of the elevator car 3 at a certain floor or the maintenance of the elevator car at a desired place in the elevator shaft 1, the brake regulating apparatus according to the present invention is activated manually. During the loading and unloading, the activated regulating apparatus prevents the movement of the elevator car 3. During maintenance operations, the regulating apparatus is used for locating the elevator car 3 at any desired place in the shaft 1. The activation of the brake regulating apparatus control 16 takes place by means of the elevator control 27, which in turn is brought into the respective operational state by means of not illustrated manual switches. The control 16 in that case switches the valve 22 on and sets the pressure regulating valve 22.1 to the maximum value so that the elevator car 3 is held fast to the guide rails 2 with the maximum braking force of the brake actuator 14. To free the elevator car 3, the valve 22 and the valve 22.1 are switched off, whereby the pressured fluid in the cylinder chamber 14.1 can be relieved to the reservoir 19.1 by way of the throttle valve 22.3. The speed of decay of the braking force is set at the throttle valve 22.3.

Figure 12:
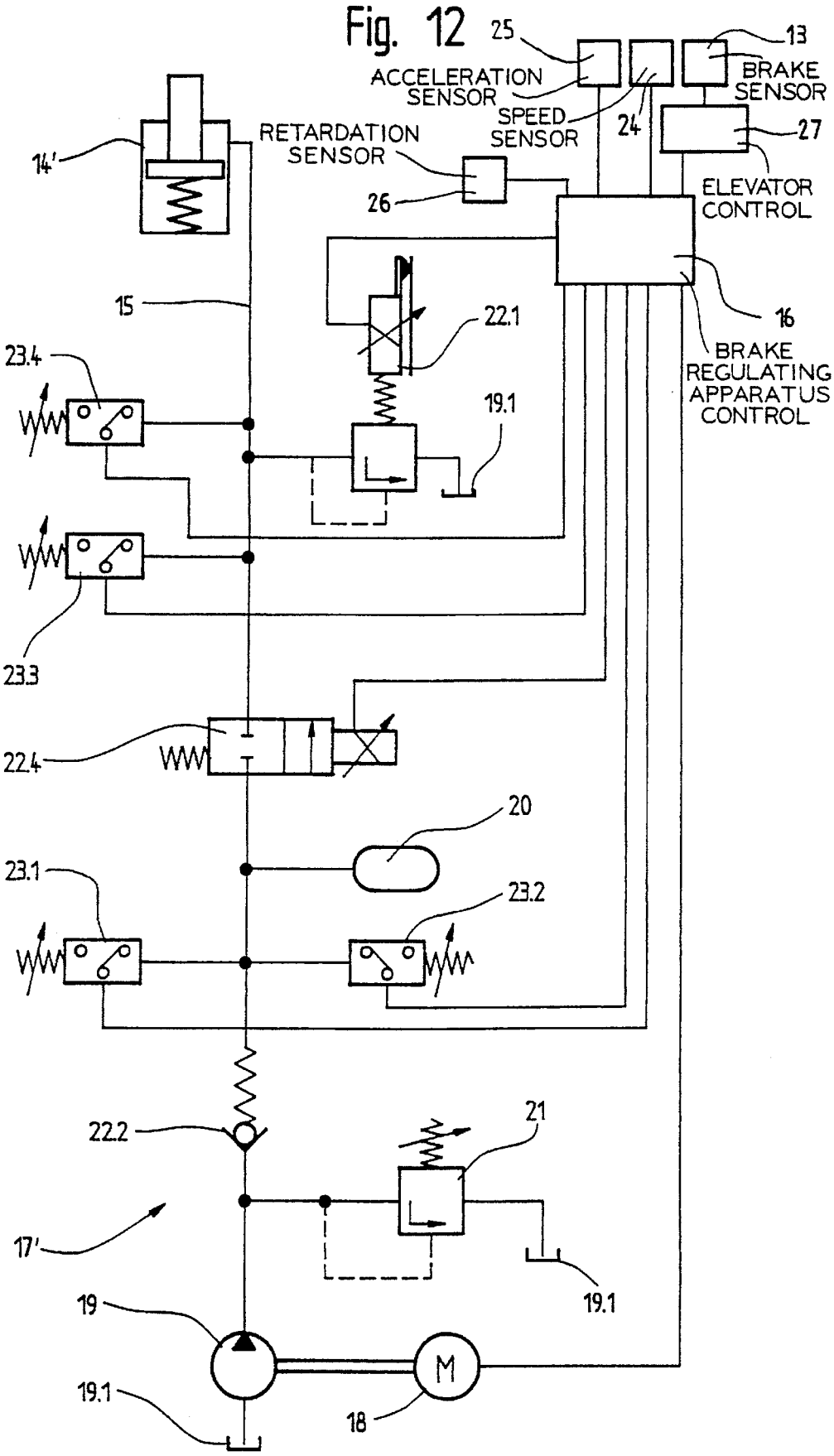
FIG. 12 is a schematic diagram of an alternate embodiment of the hydraulic elevator system shown in the FIG. 11.

An alternate embodiment of the pressure medium source 17, which incorporates the embodiment of the brake actuator 14' illustrated in the FIGS. 9 and 10, is illustrated in the FIG. 12 as a source 17'. A two/two way control valve 22.4 is substituted for the control valve 22 and a third pressure switch 23.3 and a fourth pressure switch 23.4 each have an input connected to the line 15 and an output connected to an input to the brake regulating apparatus control 16. An output port of the valve 22.4 and the input port of the valve 22.1 are connected to the line 15 while the output port of the valve 22.1 is connected to the reservoir 19.1. In the absence of pressured fluid, the compression spring 14.4' urges the brake pad 12 against the running surface 2.3 of the guide rail 2. Thereby, the elevator car 3 is firmly held on the guide rails 2 with a maximum braking force. For the establishment and the maintenance of the operational readiness of the pressure medium source 17', the brake regulating apparatus control 16, in connection with the elevator control 27, switches the motor 18 on and off on the basis of the signals generated by the first pressure switch 23.1 and the second pressure switch 23.2. When the storage pressure in the accumulator 20 fails below a minimum pressure set at the first pressure switch 23.1, the control 16, in response to the pressure switch signals, switches the motor 18 on, which motor remains switched on until the maximum pressure set at the second pressure switch 23.2 is reached. The storage pressure is maintained greater than the braking pressure required for the braking of the elevator car.

Now, the brake regulating apparatus control 16 switches the valve 22.4 on and pressured fluid flows into the cylinder chamber 14.1' of the brake actuator 14', whereby the compression spring 14.4' is compressed. On reaching the maximum braking pressure set at the fourth pressure switch 23.4, the control 16 closes the valve 22.4, during which the pressure regulating valve 22.1 is set so that no pressured fluid can flow away to the reservoir 19.1. In this operational state of the pressure medium source 17', the brake pads 12 are raised off of the running surfaces 2.3 of the guide rail 2. In case the braking pressure falls below a minimum braking pressure set at the third pressure switch 23.3, the valve 22.4 is switched on until the braking pressure has again reached the maximum value.

In the case of a fault or emergency during the downward direction of travel, the brake regulating apparatus control 16 sets the pressure regulating valve 22.1 in response to the signals generated by the acceleration sensor 25 or the speed sensor 24 so that the pressure in the cylinder chamber 14.1' is reduced until the compression spring 14.4' urges the brake pads 12 against the running surfaces 2.3 and a braking effect is achieved. At the same time, the retardation sensor 26 mounted at the fastening housing 6 measures the retardation of the elevator car 3. The brake regulating apparatus control 16 changes the setting of the pressure regulating valve 22.1 on the basis of the signal from the retardation sensor 26. In the case of retardation values below the ordinary gravitational acceleration, the control 16 changes the setting of the valve 22.1 in such a manner that the braking force of the brake actuator 14' is reduced until a retardation value corresponding to the ordinary gravitational acceleration is reached. If retardation values which are greater than the ordinary gravitational acceleration result due to different conditions of friction on the running surfaces 2.3 of the guide rail 2, the control 16 corrects the braking force of the brake actuator 14' by appropriate setting of the valve 22.1 and by switching the valve 22.4 on until retardation values corresponding to the ordinary gravitational acceleration are reached. The retardation of the elevator car 3 remains constant and follows a predetermined value during the entire braking operation. The control 16 compares the predetermined value, for example the ordinary gravitational acceleration, with the value measured at the elevator car 3 by means of the retardation sensor 26 and balances out differences between the values by greater or lesser loading of the brake actuator 14' by means of the valve 22.4 and the valve 22.1. As soon as the elevator car 3 has come to standstill, the brake regulating apparatus control 16 closes the valve 22.4 and changes the setting of the pressure regulating valve 22.1 in such a manner that the compression spring 14.4' urges the brake pad 12 with the maximum spring force against the running surface 2.3 of the guide rail 2. The elevator car 3 is thereby maintained in position in the elevator shaft 1.

In the case of a fault or emergency in the upward direction of travel, the braking operation takes place in substantially the same manner as for the case of a fault or emergency in the downward direction of travel. By reason of the opposite direction of movement ascertained by the speed sensor 24, the brake regulating apparatus control 16 fixes retardation values which lie below the ordinary gravitational acceleration and influences the braking force of the brake actuator 14' accordingly.

For the loading or unloading of the elevator car 3 at a certain floor or for the maintenance of the elevator car at a desired place in the elevator shaft 1, the apparatus according to the present invention is activated manually. During loading and unloading, the activated apparatus prevents the movement of the elevator car 3. In the case of maintenance operations, the apparatus is used for locating the elevator car 3 at a desired place in the shaft 1. The activation of the brake regulating apparatus control 16 takes place in response to signals from the elevator control 27, which in its turn is brought into the respective operational states by means of not illustrated manual switches. The control 16 changes the setting of the pressure regulating valve 22.1 in such a manner that the compression spring 14.4' urges the brake pad 12 with the maximum spring force against the running surface 2.3 of the guide rail 2 so that the elevator car 3 is held fast to the guide rails. To free the elevator car 3, the control 16 switches the control valve 22.4 on whilst the pressure regulating valve 22.1 is so set that no pressured fluid can flow away to the reservoir 19.1. In this operational state of the pressure medium source 17', the brake pads 12 are raised off of the running surfaces 2.3 of the guide rails 2 and the elevator car 3 is again freely movable.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for applying a regulated braking force to an elevator car comprising:

a brake shoe for attachment to an elevator car;

a brake pad for engaging a running surface formed on a guide rail along which the elevator car travels, said brake pad being retained by said brake shoe for movement relative to said brake shoe toward and away from the running surface;

a fastening housing for attachment to an elevator car and having at least one recess formed therein;

a brake guide attached to said brake shoe and being retained in said recess;

at least one cushion pad formed of an elastic material and mounted in said recess in contact with said brake guide whereby said brake shoe and said retained brake pad follow deviations in a shape of the guide rail during application of the regulated braking force to prevent generation of additional forces on the guide rail; and a brake actuator including a cylinder chamber formed in said brake shoe and a piston slidable in said cylinder chamber and being connected to said brake pad whereby selective application of pressured fluid to said cylinder chamber and removal of pressured fluid from said cylinder chamber moves said piston in said cylinder chamber and moves said brake pad into engagement with the running surface and out of engagement with the running surface to apply a regulated braking force to the elevator car.

2. The apparatus according to claim 1 including a brake regulating apparatus control having an inlet port for connection to a source of pressured fluid and an outlet port being connected to said cylinder chamber for selectively applying the pressured fluid to and removing the pressured fluid from said cylinder chamber whereby a relatively constant regulated braking force is exerted on the elevator car.

3. The apparatus according to claim 2 wherein said brake regulating apparatus control applies the pressured fluid to said cylinder chamber to move said brake pad into engagement with the running surface.

4. The apparatus according to claim 2 wherein said brake actuator includes a biasing means coupled to said piston and moving said brake pad into engagement with the running surface and said brake regulating apparatus control applies the pressured fluid to said cylinder chamber to move said brake pad out of engagement with the running surface.

5. The apparatus according to claim 4 wherein said biasing means is a compression spring.

6. The apparatus according to claim 2 wherein said brake regulating apparatus control includes a retardation sensor for sensing an actual retardation at which the elevator car is travelling during braking and said brake regulating apparatus control selectively applies the pressured fluid to said cylinder chamber to maintain the actual retardation at a predetermined value.

7. The apparatus according to claim 2 wherein said brake regulating apparatus control includes a speed sensor for sensing an actual speed at which the elevator car is travelling and said brake regulating apparatus control is responsive to the actual speed exceeding a predetermined value for selectively applying the pressured fluid to said cylinder chamber.

8. The apparatus according to claim 2 wherein said brake regulating apparatus control includes an acceleration sensor for sensing an actual acceleration at which the elevator car is travelling and said brake regulating apparatus control is responsive to the actual acceleration exceeding a predetermined value for selectively applying the pressured fluid to said cylinder chamber.

9. The apparatus according to claim 2 wherein said brake regulating apparatus control is connected to an elevator control for the elevator car and is responsive to a signal generated by the elevator control for applying a maximum braking force to maintain the elevator car in position during loading and unloading at a floor and during maintenance operations.

10. The apparatus according to claim 2 wherein said brake regulating apparatus control is connected to an elevator control for the elevator car and including a brake sensor attached to said brake pad and connected to the elevator control for sensing wear of said brake pad and generating a signal to the elevator control representing the wear of said brake pad, the elevator control and said brake regulating apparatus control being responsive to said brake sensor signal for selectively applying the pressured fluid to said cylinder chamber to stop the elevator car.

11. The apparatus according to claim 2 wherein said brake regulating apparatus control includes a control; a control valve having said inlet port, said outlet port and an actuator connected to said control; a pressure regulating valve having an inlet port connected to said outlet port of said control valve, an outlet port connected to one of said cylinder chamber and a fluid reservoir for the pressured fluid source and a pressure adjusting portion connected to said control; at least one of a car speed sensor and a car acceleration sensor connected to said control; and a car retardation sensor connected to said control, said control being responsive to a car condition sensed by said one of said car speed sensor and said car acceleration sensor for actuating said control valve and being responsive to a car condition sensed by said retardation sensor for controlling a pressure at which said pressure regulating valve regulates.

12. The apparatus according to claim 11 including a pair of pressure switches each having an input connected to said control valve outlet port and an output connected to said brake regulating apparatus control for sensing and generating signals representing a maximum fluid pressure and a minimum fluid pressure and wherein said outlet port of said pressure regulating valve is connected to the fluid reservoir for the pressured fluid source and said control is responsive to said signals generated by said switches for turning said control valve on and off.

13. The apparatus according to claim 2 wherein the pressured fluid source includes an electric motor connected to said brake regulating apparatus control, an hydraulic pump coupled to be driven by said motor and having an inlet connected to said brake regulating apparatus control and an outlet, a reservoir for fluid connected to said pump inlet, a pressured fluid accumulator connected to said pump outlet, first and second pressure switches each having an input connected to said fluid accumulator and an output connected to said brake regulating apparatus control and a pressure limiting valve connected between said pump outlet and said reservoir, said switches sensing and generating signals representing a minimum fluid pressure and a maximum fluid pressure, said brake regulating apparatus control being responsive to said switch signals for turning on and off said motor.

14. An apparatus for applying a regulated braking force to an elevator car comprising:

a fastening housing for attachment to an elevator car and having at least one recess formed therein;

a brake shoe having at least one brake guide attached thereto and being retained in said recess;

at least one brake pad for engaging a running surface formed on a guide rail along which the elevator car travels, said brake pad being retained by said brake shoe;

at least one brake actuator mounted in said brake shoe and being coupled to said brake pad for moving said brake pad into engagement with the running surface;

a brake regulating apparatus control for selectively applying pressured fluid to said brake actuator whereby a relatively constant regulated braking force is exerted on the elevator car;

a control valve having an inlet port for connection to a source of pressured fluid, an outlet port being connected to said brake actuator and an actuator connected to said brake regulating apparatus control;

a pressure regulating valve having an inlet port connected to said outlet port of said control valve, an outlet port connected to one of said brake actuator and a fluid reservoir for the pressured fluid source and a pressure adjusting portion connected to said brake regulating apparatus control;

at least one of a car speed sensor and a car acceleration sensor connected to said brake regulating apparatus control;

a car retardation sensor connected to said brake regulating apparatus control, said brake regulating apparatus control being responsive to a car condition sensed by said one of said car speed sensor and said car acceleration sensor for actuating said control valve and being responsive to a car condition sensed by said retardation sensor for controlling a pressure at which said pressure regulating valve regulates; and a pair of pressure switches each having an input connected to said control valve outlet port and an output connected to said brake regulating apparatus control for sensing and generating signals representing a maximum fluid pressure and a minimum fluid pressure and wherein said outlet port of said pressure regulating valve is connected to the fluid reservoir for the pressured fluid source and said brake regulating apparatus control is responsive to said signals generated by said switches for turning said control valve on and off.

15. An apparatus for applying a regulated braking force to an elevator car comprising:

a brake shoe for attachment to an elevator car;

a brake pad for engaging a running surface formed on a guide rail along which the elevator car travels, said brake pad being retained by said brake shoe for movement relative to said brake shoe toward and away from the running surface;

a brake actuator including a cylinder chamber formed in said brake shoe and a piston slidable in said cylinder chamber and being connected to said brake pad;

a brake regulating apparatus control connected to said brake actuator for selectively applying pressured fluid to said cylinder chamber and removing pressured fluid from said cylinder chamber to move said piston in said cylinder chamber and to move said brake pad into engagement with the running surface and out of engagement with the running surface to apply a regulated braking force to the elevator car; and a retardation sensor connected to said brake regulating apparatus control for sensing an actual retardation at which the elevator car is travelling during braking whereby said brake regulating apparatus control is responsive to said actual retardation for selectively applying the pressured fluid to said cylinder chamber to maintain the actual retardation at a predetermined value to exert a relatively constant regulated braking force on the elevator car, said predetermined value being at least one of approximately equal to gravitational acceleration during downward travel of the elevator car and less than gravitational acceleration during upward travel of the elevator car.

16. An apparatus for applying a regulated braking force to an elevator car comprising:

a fastening housing for attachment to an elevator car;

a brake shoe being retained in said fastening housing;

at least one brake pad for engaging a running surface formed on a guide rail along which the elevator car travels, said brake pad being retained by said brake shoe;

at least one pressure fluid actuated brake actuator mounted in said brake shoe and being coupled to said brake pad for moving said brake pad into engagement with the running surface;

a brake regulating means connected to said brake actuator for selectively applying pressured fluid from a source to said brake actuator whereby a relatively constant regulated braking force is exerted on the elevator car;

a speed sensor connected to said brake regulating means for sensing an actual speed at which the elevator car is travelling;

an acceleration sensor connected to said brake regulating means for sensing an actual acceleration at which the elevator car is travelling; and a retardation sensor connected to said brake regulating means for sensing an actual retardation at which the elevator car is travelling during braking whereby said brake regulating means selectively applies the pressured fluid to said brake actuator when the actual speed exceeds a first predetermined value, when the actual acceleration exceeds a second predetermined value, and to maintain the actual retardation at a third predetermined value.

17. The apparatus according to claim 16 wherein said fastening housing is adapted to be attached to an upper yoke of a carrier frame for the elevator car.

18. The apparatus according to claim 16 wherein said fastening housing is adapted to be attached to a lower yoke of a carrier frame for the elevator car.

19. The apparatus according to claim 16 wherein during downward travel of the elevator car said brake regulating apparatus control maintains the actual retardation predetermined value approximately equal to gravitational acceleration.

20. The apparatus according to claim 16 wherein during upward travel of the elevator car said brake regulating apparatus control maintains the actual retardation predetermined value ess than gravitational acceleration.

* * * * *